US005577432A

United States Patent [19]

Becker et al.

[11] Patent Number: 5,577,432

[45] Date of Patent: Nov. 26, 1996

[54] PROTECTIVE DEVICE HAVING A REACTIVE ARMOR

[75] Inventors: Wilfried Becker, Düsseldorf; Herbert Scholles, Hermannsburg; Dirk Kilfitt, Velbert, all of Germany

[73] Assignee: Rheinmetall Industrie GmbH, Ratingen, Germany

[21] Appl. No.: 554,167

[22] Filed: Nov. 6, 1995

[30] Foreign Application Priority Data

Nov. 10, 1994 [DE] Germany ..... 44 40 120.5

[51] Int. Cl.[6] ..... F41H 5/007

[52] U.S. Cl. ..... 89/36.17; 109/49.5

[58] Field of Search ..... 89/36.17; 109/36, 109/37, 49.5

[56] References Cited

U.S. PATENT DOCUMENTS

| | | | |
|---|---|---|---|
| 3,893,368 | 7/1975 | Wales, Jr. | 89/36.17 |
| 4,051,763 | 10/1977 | Thomanek | 89/36.17 |
| 4,752,970 | 6/1988 | Arakaki | 89/36.17 |

FOREIGN PATENT DOCUMENTS

| | | | |
|---|---|---|---|
| 978036 | 4/1976 | Germany | 89/36.17 |
| 2611163 | 10/1977 | Germany | 89/36.17 |
| 4122622 | 1/1993 | Germany | 89/36.17 |
| 367999 | 3/1991 | Japan | 89/36.17 |
| 2234334 | 1/1991 | United Kingdom | 89/36.17 |

*Primary Examiner*—Stephen M. Johnson
*Attorney, Agent, or Firm*—Spencer & Frank

[57] ABSTRACT

A target-protecting device for rendering harmless a projectile impacting on the device includes a reactive armor extending over the target and being composed of a plurality of individually electrically ignitable modules. Each module has an explosively acceleratable armor plate. An additional armor extends over and is positioned at a distance from, the reactive armor. A sensor arrangement is provided at the additional armor for emitting a signal identifying a location of projectile impact on the additional armor. An electronic monitoring device receives signals from the sensor arrangement for determining, from the signals, a position of the projectile upon penetration of the additional armor and for applying an ignition signal to a respective module to explosively accelerate the armor plate of such module toward the projectile.

9 Claims, 2 Drawing Sheets

PROTECTIVE DEVICE HAVING A REACTIVE ARMOR

BACKGROUND OF THE INVENTION

This invention relates to a protective device having a reactive armor for protecting stationary or moving targets such as bunkers, dugouts, land vehicles or water craft. The reactive armor is composed of individually electrically ignitable modules each having, on their side oriented away from the target, an armor plate removable by an explosive blast. Each module is connected, by means of an electronic monitoring device, with at least one sensor which activates the module as a projectile approaches.

Protective devices of the above-outlined type are disclosed, for example, in German Offenlegungsschrift (application published without examination) 41 22 622. The protective device is formed essentially of a modular reactive armor which is placed directly on the surface of the target to be protected and is provided with electromagnetic radar distance sensors. The distance from an approaching projectile is computed according to the Doppler-shift principle. From the data thus obtained the moment is determined at which the armor plate of a corresponding module is to be activated and accelerated transversely to its plane against the incoming projectile.

It is a disadvantage of known protective devices of the above-outlined type that they involve substantial technical and constructional outlay as concerns the required distance sensors and also, difficulties have been experienced in using such high frequency sensors. Thus, for example, an expensive cable system for the ribbon conductor antennae as well as expensive control for the transmitter is required. Further, disturbances such as multiple reflections and thus erroneous measuring results are possible in case several close-by vehicles (such as tanks) are provided with distance sensors of this type. Further, the modules of the reactive armor positioned unprotected on the surface of the target can be triggered even by small-caliber projectiles. It is a further drawback that the principal armor still has to be relatively strong and thus heavy because the projectiles are only preliminarily fragmented by the modules and therefore have a relatively high kinetic energy.

German Patent No. 978,036 discloses a protective device which includes a grid-like system of shaped charges and optical barriers. As a projectile passes through one of the optical barriers, a corresponding shaped charge is fired to damage the projectile.

It is a disadvantage of shaped charges of the this type that they involve a relatively high constructional outlay as concerns the optical barriers which have to be adjusted with precision. Further, a great number of shaped charges are required because the shaped charge jet designed to hit the projectile is relatively narrow.

U.S. Pat. No. 3,893,368 discloses a protective device in which, as a projectile impacts on an electronic element an ignition voltage is generated which ignites a shaped charge. The shaped charge is arranged in such a manner that its effective direction is parallel to the surface to be protected and perpendicular to the flight direction of the projectile. By means of the particle jet and the shock wave the projectile is to be destroyed or deflected.

In such a protective device too, a correspondingly large number of shaped charges are required to ensure that the incoming projectile is securely intercepted.

SUMMARY OF THE INVENTION

It is an object of the invention to provide an improved protective device of the above-outlined type which is of simple construction, which reliably provides safety against kinetic-energy projectiles, yet requires only a slight principal armor for the target to be protected.

This object and others to become apparent as the specification progresses, are accomplished by the invention, according to which, briefly stated, the target-protecting device for rendering harmless a projectile impacting on the device includes a reactive armor extending over the target and being composed of a plurality of individually electrically ignitable modules. Each module has an explosively acceleratable armor plate. An additional armor extends over and is positioned at a distance from, the reactive armor. A sensor arrangement is provided at the additional armor for emitting a signal identifying a location of projectile impact on the additional armor. An electronic monitoring device receives signals from the sensor arrangement for determining, from the signals, a position of the projectile upon penetration of the additional armor and for applying an ignition signal to a respective module for explosively accelerating the armor plate of such module toward the projectile.

In essence, the invention is based on the principle to arrange, ahead of the reactive armor, an additional armor which is connected with a passive sensor. Upon impact of a projectile on the additional armor, an electronic monitoring device connected with the sensor transmits signals representing the position of the projectile and triggers the corresponding module of the reactive armor. By virtue of the additional armor there is also effected an initial fragmentation of the projectile so that the reactive armor causes a further breakup of the projectile components which may be caught by a relatively thin catching plate constituted, for example, by the principal armor.

According to a particularly advantageous feature of the invention, sensor films are applied on the opposite front and reverse sides of the additional armor. In this manner, the electronic monitoring device is capable of determining not only the position but also the velocity and direction of the projectile and thus can trigger that module which is best positioned to destruct the projectile components. The electronic monitoring device may also aim a weapon in the direction from which the projectile was launched.

According to a further feature of the invention, the additional armor is formed of two armor plates situated at a slight distance behind one another. Each of the armor plates is composed of a plurality of individual small plates (plate elements). If the plate elements are sufficiently small, the sensing of the impacted plate of the additional armor is sufficient to compute the flight direction of the preliminarily damaged (initially fragmented) projectile and to trigger the associated module of the reactive armor. In such a case, film sensors may be dispensed with and impact or acceleration sensors may be used instead. Each plate element of the additional armor is associated with its own sensor of the above-outlined type.

To provide a high degree of safety against hits by small-caliber projectiles, it has been found advantageous to provide yet another, supplemental armor ahead of the additional armor.

The individual modules of the reactive armor are expediently arranged alternatingly obliquely to the surface to be protected to obtain a maximum effect against the projectiles.

To reduce damages by the explosively accelerated armor plates upon triggering of a module, according to an advantageous feature of the invention between adjoining reactive elements a catching element (such as a sheet metal member, a grid or the like) is provided. These structural elements serve simultaneously for mounting the outer armor.

According to still another advantageous feature of the invention, as a protection against shaped charges, between the additional armor and the reactive armor a corrugated, dented or embossed sheet metal member is arranged.

DESCRIPTION OF THE PREFERRED EMBODIMENTS

Figure 1:
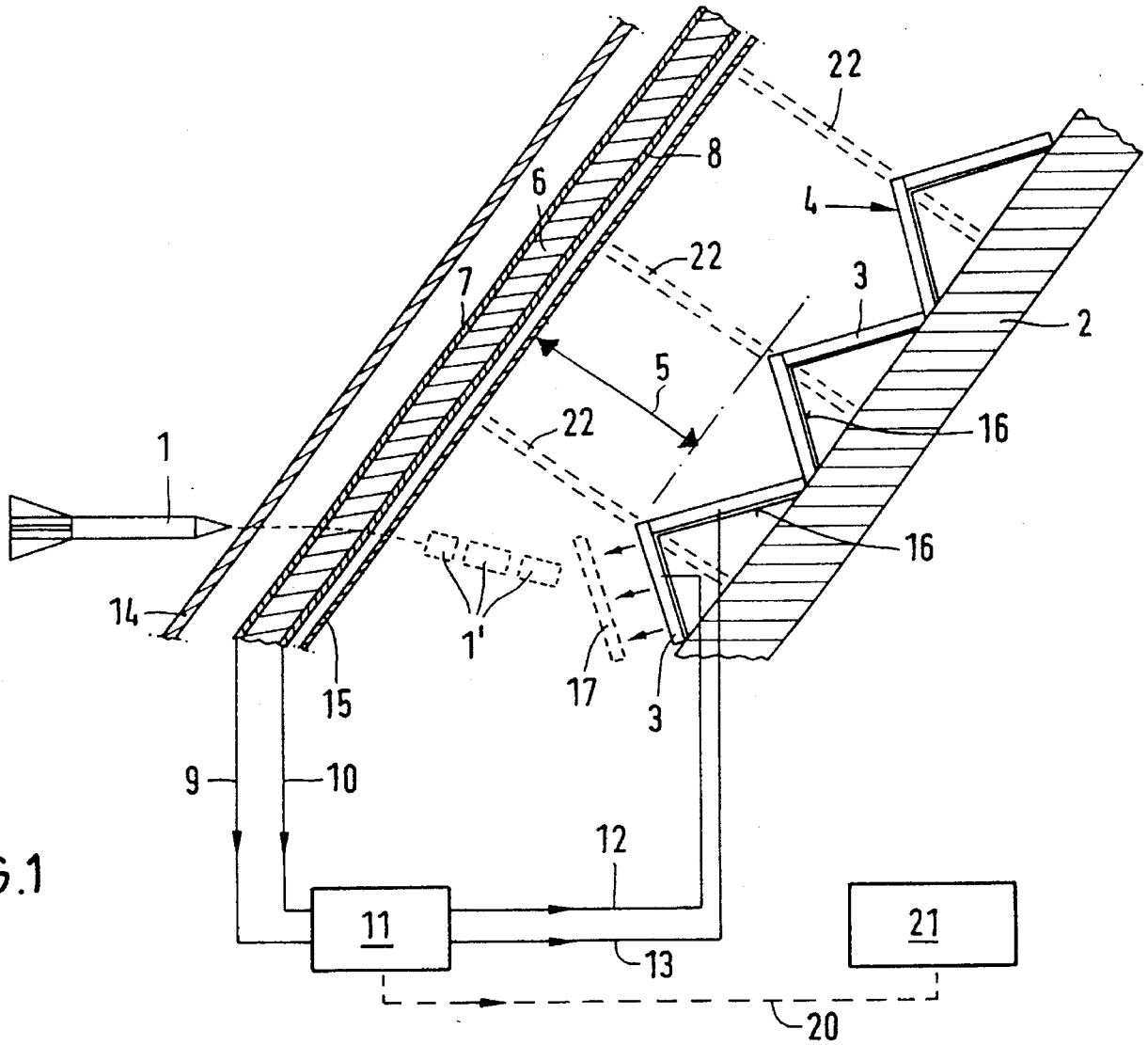
FIG. 1 is a schematic sectional side elevational view of a protective device according to a preferred embodiment of the invention.

In FIG. 1 there is illustrated a kinetic-energy projectile 1 which flies in the direction of the principal armor 2 of a non-illustrated target (such as a tank). In front of the armor 2 a reactive armor 4 is positioned which is formed of a plurality of modules 3 (only six are shown for better visibility). On that side of the reactive armor 4 which is oriented away from the armor 2, an additional armor 6 is positioned which is at a predetermined distance 5 from the reactive armor 4. On the front and reverse sides of the additional armor 4 respective sensor films 7, 8 are arranged which are connected by means of electric conductors 9, 10 with an electronic monitoring device 11, such as a micro-controller. The output of the electronic monitoring device 11 is connected with the modules 3 by electric conductors 12 and 13 (for clarity, only two of the modules 3 are shown to be connected with the device 11).

To render the protective device insensitive to a substantial extent against small-caliber projectiles, a supplemental armor plate 14 is provided in front of the additional armor 6. Further, between the additional armor 6 and the reactive armor 4 an embossed sheet metal component 15 is arranged which is designed to interfere with the particle jet of any shaped charge.

In the description which follows, the mode of operation of the device illustrated in FIG. 1 will be described in greater detail.

After penetrating the supplemental armor plate 14, the projectile 1 first contacts the outer sensor foil 7 which generates a corresponding signal from which the electronic monitoring device 11 determines the position (that is, the coordinates relative to a reference point) of the entry of the projectile 1. Upon passing through the additional armor 6, the direction of the projectile 1 is slightly changed and the projectile is initially fragmented and thereafter passes through the inner sensor film 8 which too, produces a signal from which the electronic monitoring device 11 determines the coordinates of the impact position on the film relative to a reference point.

From the coordinates of the location of passages through the two sensor films 7 and 8 the electronic monitoring device 11 computes the direction of flight of the initially fragmented projectile 1' and selects that module or those modules 3 which should be triggered in order to interfere with the projectile 1' in an optimal manner. The triggering signal for the selected module 3 is activated by the electronic monitoring device 11 and is transmitted by corresponding conductors 12, 13 to the electrically ignitable explosive film 16. The corresponding armor plate 17 of the module 3 moves, explosively accelerated, towards the initially fragmented projectile 1' and destroys it.

In order to ensure a maximum effectiveness of the individual modules 3, they are arranged in a zigzag pattern, that is, at an alternating oblique inclination to the surface of the target to be protected.

The distance 5 between the additional armor 6 and the reactive armor 4 has to be selected such that a sufficient path is available for "consuming" the projectile 1 by the explosively accelerated armor plate 17 and should be preferably in the magnitude of one-half of the expected length of the projectile penetrator.

Figure 2:
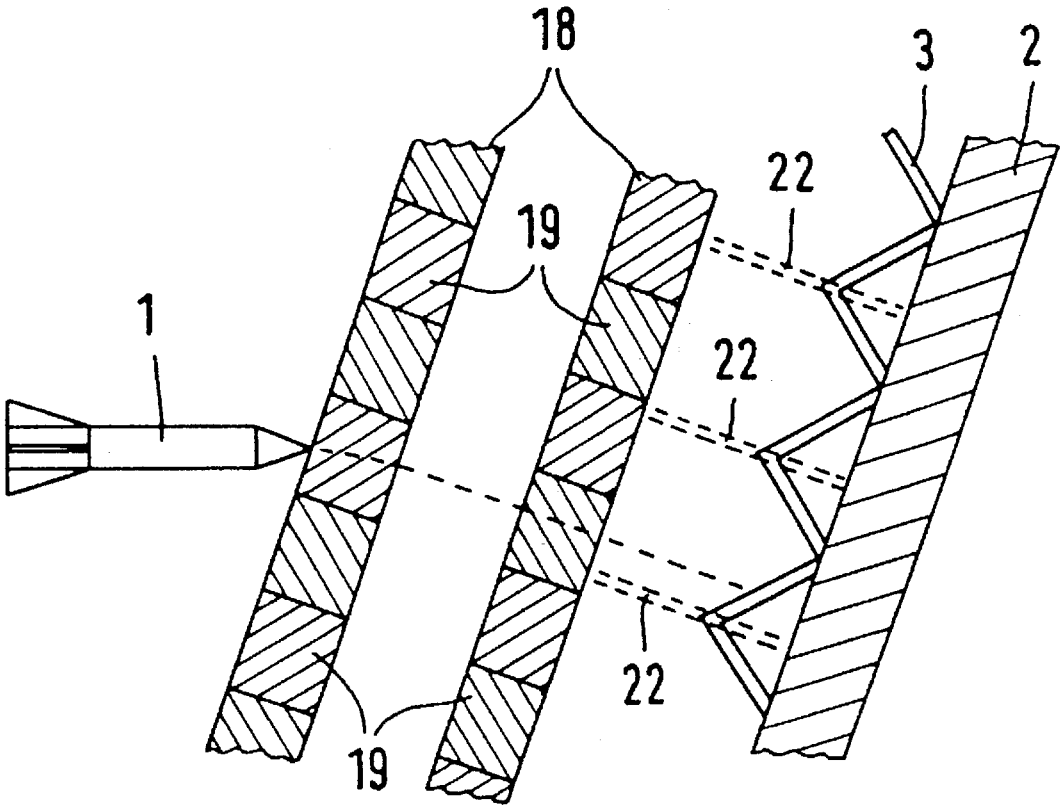
FIG. 2 is a sectional side elevational view of another preferred embodiment of the invention.

FIG. 2 illustrates a further embodiment of the invention according to which the additional armor 18 is formed of two parallel-spaced armor plates each composed of individual armor plate elements 19. Instead of the two film sensors 7,8 used in the embodiment of FIG. 1, it is sufficient in the embodiment of FIG. 2 to provide, for each armor plate element 19, a shock or acceleration sensor which identifies that armor plate element 19 which has been contacted by the projectile 1. This information is applied to the electronic monitoring device 11 (FIG. 1) which, according to a predetermined schedule, selects and ignites the corresponding module 3 of the reactive armor 4.

It will be apparent that the invention is not limited to the above-described embodiments. Thus, for example, the electronic monitoring device 11 may be connected by means of an electric conductor 20 shown in dash-dotted lines in FIG. 1 with a master system 21 of the target (tank). Such a master system may be, for example, an on-board computer or a weapon control system. The electronic monitoring device 11 may, based on the sensed data, compute the projectile velocity and location of launching and inform the system 21 accordingly. In response, the system 21 may aim its weapons against the adversary.

To avoid or at least reduce damages by the explosively accelerated armor plate 17, expediently between adjoining modules 3 a catching element (such as a sheet metal member or grid) 22 is provided as shown in dashed lines in FIGS. 1 and 2. In this manner damages to adjacent modules 3 by projectile fragments or the explosively accelerated armor plates 17 is prevented. The catching elements 22 simultaneously serve as mounting components for the outer armor.

It will be understood that the above description of the present invention is susceptible to various modifications, changes and adaptations, and the same are intended to be comprehended within the meaning and range of equivalents of the appended claims.

What is claimed is:

1. A target-protecting device for rendering harmless a projectile impacting on the device, comprising (a) a reactive armor extending over the target; said reactive armor being composed of a plurality of individually electrically ignitable modules; each module having an explosively acceleratable armor plate;

(b) an additional armor extending over and positioned at a distance from, said reactive armor;

(c) sensor means arranged at said additional armor for emitting a signal identifying a location of projectile impact on said additional armor; and (d) electronic monitoring means receiving signals from said sensor means for determining, from said signals, a position of the projectile upon penetration of said additional armor and for applying an ignition signal to a respective said module to explosively accelerate the armor plate thereof toward the projectile.

2. The target-protecting device as defined in claim 1, wherein said additional armor has opposite front and reverse faces; further wherein said sensor means includes first and second sensor films mounted on said front and reverse faces, respectively; said electronic monitoring means comprising means for determining, from signals transmitted by said first and second sensor films, an orientation of the projectile relative to the target.

3. The target-protecting device as defined in claim 1, wherein said additional armor is composed of individual armor plate elements.

4. The target-protecting device as defined in claim 1, wherein said armor plates of said reactive armor are arranged at an alternating inclination to a plane of the target.

5. The target-protecting device as defined in claim 4, wherein said armor plates of said reactive armor are arranged in a zigzag pattern.

6. The target-protecting device as defined in claim 1, further comprising a supplemental armor extending over said additional armor for protection against small-caliber projectiles; said additional armor being situated between said supplemental armor and said reactive armor.

7. The target-protecting device as defined in claim 1, further comprising a catch plate situated adjacent said reactive armor for catching projectile and armor fragments; said reactive armor being situated between said additional armor and said catch plate.

8. The target-protecting device as defined in claim 1, further comprising an embossed plate situated between said additional armor and said reactive armor.

9. The target-protecting device as defined in claim 1, further comprising (e) a principal armor extending below said reactive armor; said reactive armor being situated between said principal armor and said additional armor; and (f) a plurality of spaced catching elements extending between adjoining said modules and connecting said additional armor with said principal armor.

* * * * *